US011920430B2

(12) United States Patent
Rennison et al.

(10) Patent No.: US 11,920,430 B2
(45) Date of Patent: Mar. 5, 2024

(54) ADJUSTABLE INJECTION VALVE FOR A PLUG AND ABANDONMENT ANCHORING DEVICE

(71) Applicant: Halliburton Energy Services, Inc., Houston, TX (US)

(72) Inventors: Paul Rennison, Aberdeen (GB); Roger Clark, Aberdeen (GB); Geir Jørgensen, Tau (NO); Robert Walker, Aberdeen (GB); Kristoffer Landre, Sola (NO); Katherine Davies, Carnoustie (GB)

(73) Assignee: Halliburton Energy Services, Inc., Houston, TX (US)

( * ) Notice: Subject to any disclaimer, the term of this patent is extended or adjusted under 35 U.S.C. 154(b) by 141 days.

(21) Appl. No.: 17/565,558

(22) Filed: Dec. 30, 2021

(65) Prior Publication Data

US 2022/0341286 A1 Oct. 27, 2022

Related U.S. Application Data

(60) Provisional application No. 63/179,866, filed on Apr. 26, 2021.

(51) Int. Cl.
*E21B 34/10* (2006.01)
*E21B 33/134* (2006.01)

(52) U.S. Cl.
CPC ..... *E21B 34/10* (2013.01); *E21B 33/134* (2013.01)

(58) Field of Classification Search
CPC ..... E21B 23/0411; E21B 34/10
See application file for complete search history.

(56) References Cited

U.S. PATENT DOCUMENTS

| | | | | |
|---|---|---|---|---|
| 1,806,872 | A * | 5/1931 | Boynton | E21B 34/10 417/115 |
| 2,196,658 | A * | 4/1940 | Burt | E21B 33/134 166/194 |
| 3,398,796 | A * | 8/1968 | Fisher, Jr. | E21B 33/124 166/146 |
| 5,522,418 | A | 6/1996 | Johnson et al. | |
| 2005/0109500 | A1 | 5/2005 | Naizer et al. | |
| 2016/0186500 | A1 | 6/2016 | Kang et al. | |
| 2019/0040697 | A1 | 2/2019 | Barker | |

FOREIGN PATENT DOCUMENTS

| | | |
|---|---|---|
| CN | 112177561 | 1/2021 |
| WO | 2015103686 | 7/2015 |
| WO | 2015178881 | 11/2015 |

OTHER PUBLICATIONS

PCT Application No PCT/US2021/065602 , International Search Report and Written Opinion, dated Apr. 1, 2022, 10 pages

* cited by examiner

*Primary Examiner* — Cathleen R Hutchins
(74) *Attorney, Agent, or Firm* — Kilpatrick Townsend & Stockton LLP

(57) ABSTRACT

A wellbore anchoring device having an adjustable injection valve is disclosed. The anchoring device can include the adjustable injection valve and a spring. The spring can be positioned adjacent to the adjustable injection valve. The spring can include an initial pressure setting that is adjustable prior to the anchoring device being positioned in a wellbore to adjust a cracking pressure of the adjustable injection valve.

17 Claims, 9 Drawing Sheets

ADJUSTABLE INJECTION VALVE FOR A PLUG AND ABANDONMENT ANCHORING DEVICE

CROSS-REFERENCE TO RELATED APPLICATION

This claims priority to U.S. Provisional Application Ser. No. 63/179,866, filed Apr. 26, 2021 and titled "Adjustable Injection Valve for a Plug and Abandonment Anchoring Device," the contents of which are incorporated herein by reference.

TECHNICAL FIELD

The present disclosure relates generally to wellbore operations and, more particularly (although not necessarily exclusively), to an adjustable injection valve for a wellbore anchoring device.

BACKGROUND

A wellbore can be formed in a subterranean formation for extracting produced hydrocarbon or other suitable material. The wellbore can be abandoned for various purposes. For example, the wellbore may become depleted or may otherwise become no longer productive. A plug and abandonment operation can be performed to plug the abandoned wellbore (e.g., for reducing carbon emission or other suitable purposes). The plug and abandonment operation can involve positioning filling material (e.g., cementitious material or other suitable filling material) in the wellbore. The wellbore, upon abandonment, may include walls that are porous, may include a considerable amount of perforations, or may include other related features that can cause loss of the filling material to the subterranean formation. Other anchoring devices may not prevent or otherwise mitigate loss of the filling material to the subterranean formation. Additionally, the other anchoring devices may not be adjustable for tuning the other anchoring devices for various plug and abandonment operations having various operational parameters.

DETAILED DESCRIPTION

Figure 1:
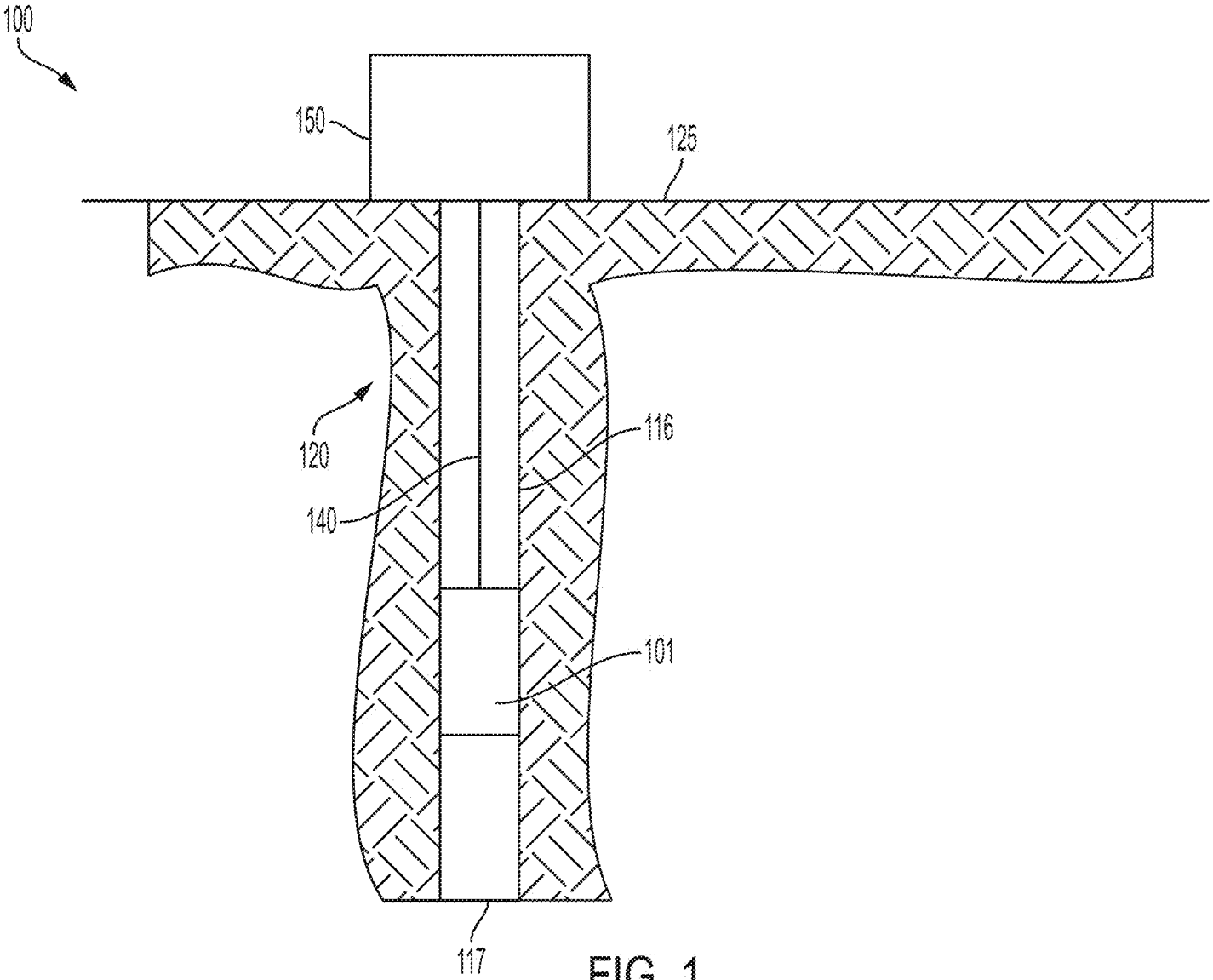
FIG. 1 is a cross-sectional view of a well system that includes an anchoring device having an adjustable injection valve for performing a plug and abandonment operation with respect to a wellbore according to one example of the present disclosure.

Certain aspects and features of the present disclosure relate to an adjustable injection valve having an adjustable cracking pressure for an anchoring device that can be positioned in a wellbore to perform one or more wellbore operations. In some examples, the wellbore operations can include a plug and abandonment operation. The plug and abandonment operation can be performed with respect to a wellbore that is depleted or for other suitable reasons such as reducing emissions from the wellbore. The anchoring device can be positioned in the wellbore to inject cement, cementitious material, or other suitable barrier material for plugging the wellbore. The anchoring device can include the adjustable injection valve, and, once positioned in the wellbore, pressure can be applied to the anchoring device, such as an opening pressure or a cracking pressure, to actuate or otherwise open the adjustable injection valve. The cracking pressure of the adjustable injection valve can be adjusted based on a formation pressure of the wellbore to optimize flow and flow control of the barrier material from the anchoring device into the wellbore. In response to actuating or otherwise opening the adjustable injection valve, the barrier material can flow from the anchoring device into the wellbore to plug the wellbore.

Placing cement at correct or optimal depths in a wellbore in existing geographic areas having one or more wellbores can present challenges. For example, the wellbore may have been formed using low formation pressure, which can cause one or more problems relating to fluid flow in the wellbore during a plug and abandonment operation. In examples in which a wellbore is formed using low formation pressure, a hydrostatic head in the wellbore can exceed a formation pressure of the wellbore, which can cause unpredictable or uncontrollable flow of fluids in the wellbore. For example, barrier fluid can be positioned in the wellbore formed using low formation pressure, and the barrier fluid may flow into the formation instead of plugging the wellbore.

Using an anchoring device that includes an adjustable injection valve can address problems relating to unpredictable or uncontrollable fluid flow in the wellbore during a plug and abandonment operation. For example, the adjustable injection valve can create a vacuum in the wellbore that can control flow of the fluid in the wellbore. The anchoring device can be positioned in the wellbore, and, once positioned at a correct or optimal depth in the wellbore for performing the plug and abandonment operation, pressure can be applied to the anchoring device to actuate or otherwise open the adjustable injection valve. In response to opening, the adjustable injection valve can allow controllable injection of fluid or barrier material, such as cement or cementitious material, into the wellbore.

In some examples, the anchoring device having the adjustable injection valve can be used to perform a plug and abandonment operation with respect to a wellbore regardless of the formation pressure of the wellbore. The adjustable injection valve can be adjusted using an adjustor nut that can be positioned on the anchoring device. The adjustor nut can be rotated inward or outward based on the formation pressure of the wellbore or for other suitable reasons. Rotating the adjustor nut can adjust pressure associated with the vacuum formed by the adjustable injection valve in the wellbore. In one such example, adjusting the nut inward can increase the pressure associated with the vacuum, and adjusting the nut outward can decrease the pressure associated with the vacuum. In response to rotating the adjustor nut for a plug and abandonment operation with respect to the wellbore, the adjustor nut can be locked into place, and the anchoring device can be positioned downhole for performing the plug and abandonment operation. In some examples, the anchoring device can be adjusted using other suitable components (e.g., individually without the adjustor nut, in combination with the adjustor nut, etc.).

Other valves positioned on other anchoring devices may not be adjustable. For example, the other valves may not include or otherwise interact with adjustable features, and the other valves may not be adjustable with respect to a cracking, or opening, pressure. Additionally, the other valves, once positioned on the other anchoring devices (e.g., once manufactured), may not be further adjusted. In some examples, the other valves may be configured to open easily to allow a large volume of fluid (e.g., water) to be pumped into a wellbore. During a plug and abandonment operation, however, an easily opened valve may cause damage by slamming the injection valve shut with a high frequency.

An adjustable feature (e.g., the adjustor nut) may be positioned on an anchoring device adjacent to a spring within the anchoring device. Adjusting the adjustable feature in a first direction (e.g., rotating the adjustor nut inward) can apply increasing preload to the spring, which can adjust a threshold amount of force or pressure for actuating or otherwise opening the adjustable injection valve. In some examples, the threshold amount of pressure can be the cracking pressure. The preload on the spring can be determined based on the formation pressure of the wellbore. For example, the formation pressure of the wellbore can correspond to the preload on the spring. Once the determined preload on the spring is achieved by adjusting the adjustable feature in the first direction, the preload can be locked by a locking bolt positioned on the adjustable injection valve or adjustable injection valve assembly, and the anchoring device can be positioned in the wellbore for performing the plug and abandonment operation.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a well system 100 that includes an anchoring device 101 having an adjustable injection valve for performing a plug and abandonment operation with respect to a wellbore 116 according to one example of the present disclosure. The well system 100 can include the wellbore 116 that is formed in a formation 120 (e.g., subterranean or subsea). The wellbore 116, in some examples, may be abandoned or otherwise no longer in use. The wellbore 116 can be a vertical wellbore, a horizontal wellbore, a general wellbore, an open-hole wellbore, or other suitable type of wellbore. As illustrated, the wellbore 116 is a vertical wellbore that includes a bottom 117 of the wellbore 116. The formation 120 may include hydrocarbon material, such as methane, and may additionally or alternatively include sequestered carbon-based material such as carbon monoxide, carbon dioxide, or other suitable carbon-based material. The wellbore 116 may be formed in the formation 120 for extracting produced hydrocarbons or for other suitable goals of forming the wellbore 116. The wellbore 116 may be abandoned or otherwise no longer in use. For example, the wellbore 116 may be depleted, may be unproductive or otherwise inefficient, or may be no longer used for other suitable purposes.

A plug and abandonment operation can be performed with respect to the wellbore 116. The anchoring device 101 can be used to perform the plug and abandonment operation. For example, the anchoring device 101 can be positioned downhole in the wellbore 116 for allowing filling material (e.g., cementitious material and the like) to be positioned in the wellbore 116 to plug the wellbore 116, or any suitable portion thereof. The anchoring device 101 can be positioned in the wellbore 116 using a lowering device 150 (e.g., a winch, a vehicle, etc.) via a line 140 (e.g., a wireline, a slickline, etc.). The wellbore 116 may have been formed with various formation pressures. For example, the wellbore 116 may have been formed with low formation pressure, and a hydrostatic head in the wellbore 116 can exceed a formation pressure of the wellbore 116, which can cause unpredictable or uncontrollable flow of fluids, such as the filling material, in the wellbore 116. The unpredictable flow can involve the filling material flowing into the formation 120 (e.g., via a portion or subset of the wellbore 116) instead of setting in the wellbore 116, or any suitable portion thereof, for plugging the wellbore 116.

To address the unpredictable flow, and other similar challenges, with respect to the plug and abandonment operation, the anchoring device 101 (e.g., via the adjustable injection valve) can be adjusted. For example, an adjustment feature (e.g., an adjustor nut and the like) can be adjusted to adjust a cracking pressure of the anchoring device 101. The cracking pressure may include a threshold pressure or other suitable force that, above which, a valve of the anchoring device 101 may "crack" or otherwise actuate for allowing the filling material to flow into the wellbore 116. Once actuated, the anchoring device 101 may create or otherwise apply a vacuum to the wellbore 116 that may control the filling material (e.g., prevent the filling material from flowing into the formation 120) and may allow the filling material to set in the wellbore 116 for plugging the wellbore 116.

Figure 2:
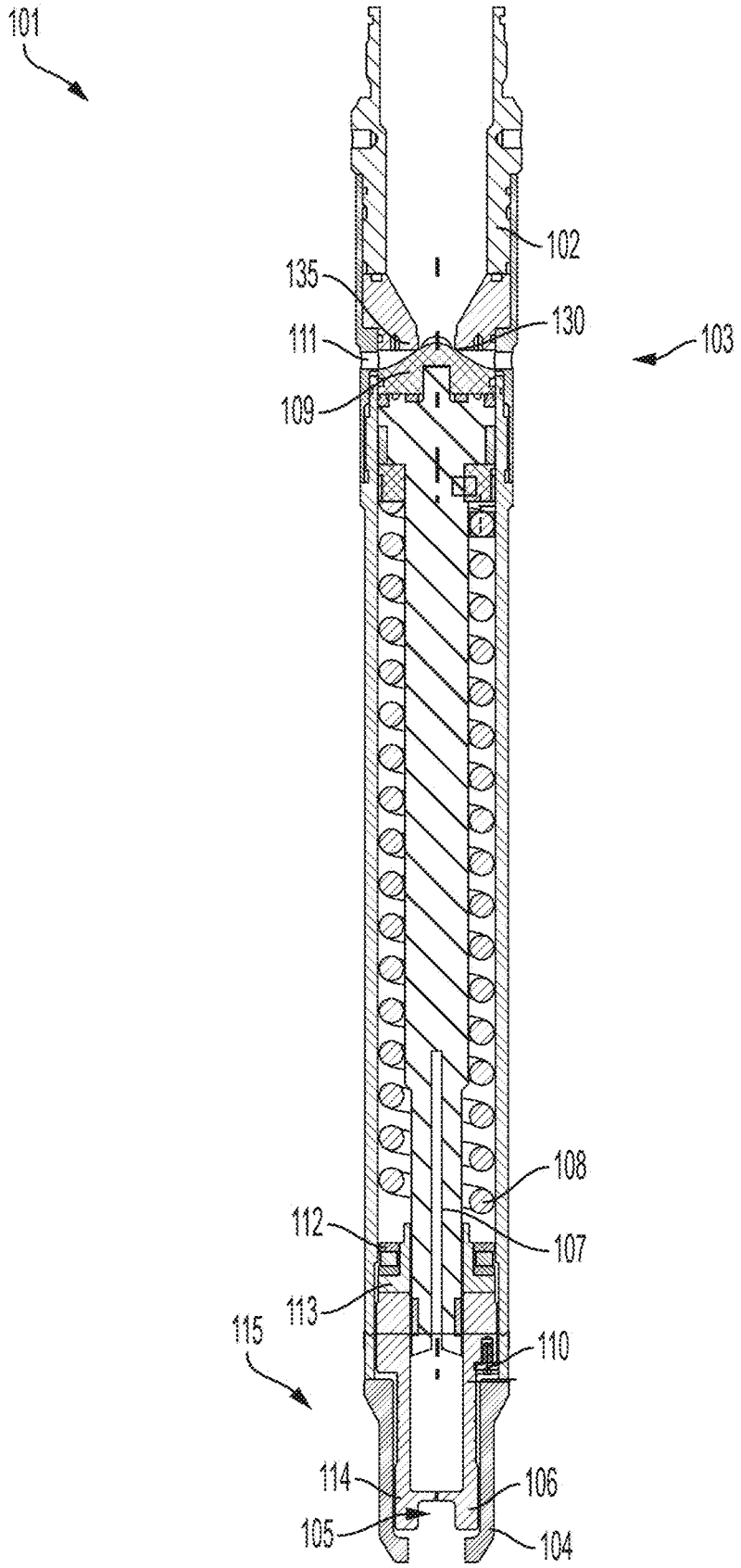
FIG. 2 is a sectional side-view of an anchoring device having an adjustable injection valve according to one example of the present disclosure.

FIG. 2 is a sectional side-view of an anchoring device 101 having an adjustable injection valve 109 according to one example of the present disclosure. The anchoring device 101 can be, can be included in, or can be coupled to, a packer that can be positioned in a wellbore. For example, as illustrated, the anchoring device 101 is positioned adjacent to a packer 102. The anchoring device 101 can include an adjustable injection valve 109, an adjustor nut 106, a spring 108, and a locking bolt 110. The anchoring device 101 can additionally or alternatively include other suitable components for facilitating a plug and abandonment operation with respect to a wellbore.

The adjustable injection valve 109 can be positioned on the anchoring device 101 on an uphole side of the anchoring device 101 adjacent, for example, to the packer 102. In some examples, the adjustable injection valve 109 can be included in an adjustable injection valve assembly that can be mechanically affixed or coupled to the anchoring device 101. The adjustable injection valve 109 can allow barrier or filling material, such as cement or a cementitious material, to flow into the wellbore 116. For example, during a plug and abandonment operation, pressure can be applied from the surface 125 of the wellbore 116 to the anchoring device 101 to actuate or otherwise open the adjustable injection valve 109. In response to receiving the pressure from the surface 125, the adjustable injection valve 109 can open, and the barrier or filling material can flow into the wellbore 116 to plug the wellbore 116. Additionally, in response to receiving the pressure from the surface 125, the adjustable injection valve 109 can cause a vacuum 105 to form. The vacuum 105 can additionally or alternatively cause the barrier or filling material to flow from the anchoring device 101 into the wellbore 116 for plugging the wellbore. The barrier material may flow through a radial hole 111 (e.g., a ported adapter sub), or other suitable component of the anchoring device 101 into the wellbore.

The adjustable injection valve 109 can include a seat 130 that, when not actuated, may abut or otherwise be adjacent to a sealing surface 135. A shape and size of the seat, the sealing surface 135, the radial hole 111, or other suitable component of the adjustable injection valve 109 can be optimized using computational flow dynamics and the like. A pressure or force that exceeds the pre-set cracking pressure may be applied to the anchoring device 101 to actuate or otherwise open the adjustable injection valve 109. Actuating the adjustable injection valve 109 can involve moving the seat 130 away from the sealing surface 135 for allowing a barrier or filling material to flow, for example, through the radial hole 111. In some examples, a backpressure may exist from the radial hole 111 to the sealing surface 135. The backpressure can cause the adjustable injection valve 109 to remain open (e.g., and may prevent the spring 108 from slamming the seat 130 against the sealing surface 135, causing damage, etc.) while the barrier or filling material is being pumped into the wellbore 116. In some examples, the barrier or filling material may not be extracted into a downhole side 115 of the anchoring device 101 during operation of the anchoring device 101.

The adjustor nut 106 can be positioned on the anchoring device 101 on a downhole side 115 of the anchoring device 101 opposite the adjustable injection valve 109. The adjustor nut 106 can be adjusted by rotation or other suitable mechanisms. In some examples, the adjustor nut 106 can be adjusted by rotating to change or optimize a preload on the spring 108. Additionally or alternatively to the adjustor nut 106, any other suitable adjustable feature or mechanism (e.g., spacer rings, etc.) can be included in, or used with respect to, the anchoring device 101 for adjusting (e.g., the cracking pressure) the anchoring device 101 for the plug and abandonment operation.

The preload can be a preset pressure applied on the spring 108 before positioning the anchoring device 101 in the wellbore 116. For example, the preload can be applied at an offsite location, at the surface 125 of the wellbore 116, or in any other suitable or similar location. The preload can correspond to a wellbore 116 associated with a plug and abandonment operation. For example, the preload can be determined based on a formation pressure of the wellbore 116 associated with the plug and abandonment operation. In some examples, the preload can allow the vacuum 105 to form under optimal conditions during the plug and abandonment operation such that the vacuum 105 can be characterized by a wellbore pressure that can control flow of fluid or the barrier material in the wellbore 116.

The spring 108 can be positioned within the anchoring device 101 and can extend from an uphole side 103 of the anchoring device 101 to the downhole side 115 of the anchoring device 101. The spring 108 can additionally be positioned adjacent to the adjustable injection valve 109. The spring 108 can apply or receive spring-related force, or other types of pressure, on the adjustable injection valve 109. Additionally, the spring 108 can receive the preload caused by the adjustor nut 106 or other suitable adjustable feature of the anchoring device 101. In some examples, increasing amounts of preload can cause an increase in a threshold pressure, such as a cracking pressure for actuating the adjustable injection valve 109, For example, the threshold pressure for a preload set at 50 bar (5,000,000 Pascals) may be lower than the threshold pressure for a preload set at 300 bar (30,000,000 Pascals). A pressure on the spring 108 that reaches or exceeds the threshold pressure can cause or allow the adjustable injection valve 109 to open for allowing the barrier material to flow into the wellbore.

Additionally, the anchoring device 101 can include one or more rotary bearings 112, such as thrust bearings. The rotary bearings 112 can be positioned adjacent to the spring 108 and to a platform 113 that is positioned adjacent to the adjustor nut 106. The platform 113 can allow pressure or other forces to be transferred between the rotary bearings 112 and the adjustor nut 106. The rotary bearings 112 can transfer pressure or other forces to be transferred between the spring 108 and the platform 113. The rotary bearings 112 can rotate around a breather hole 107 and can support axial loads within the anchoring device 101.

The adjustable injection valve 109 can include the locking bolt 110. In some examples, the locking bolt 110 can be affixed or otherwise mechanically coupled to the adjustor nut 106 for locking the preload. For example, if the preload is set to a pressure of 300 bar (30,000,000 Pascals) on the spring 108, the locking bolt 110 can be rotated to lock the pressure on the spring 108 prior to positioning the anchoring device 101 in the wellbore.

Based on the preload, a location of a bottom portion 114 of the adjustor nut 106 can vary. For example, the location of the bottom portion 114 having a preload of 50 bar (5,000,000 Pascals) can be closer to the adjustor nut 106, or other suitable adjustment feature, than the location of the bottom portion 114 having a preload of 300 bar (30,000,000 Pascals).

Additionally or alternatively, the anchoring device 101 can include a run-in-hole guide 104. The run-in-hole guide 104 can be positioned on the downhole side 115 of the anchoring device 101 adjacent to, and around, the adjustor nut 106. The run-in-hole guide 104 can guide the anchoring device 101 into the wellbore while the anchoring device 101 is undergoing a run-in-hole operation. Additionally or alternatively, the run-in-hole guide 104 can protect the adjustor nut 106 from downhole conditions that may damage or displace the adjustor nut 106.

Figure 3:
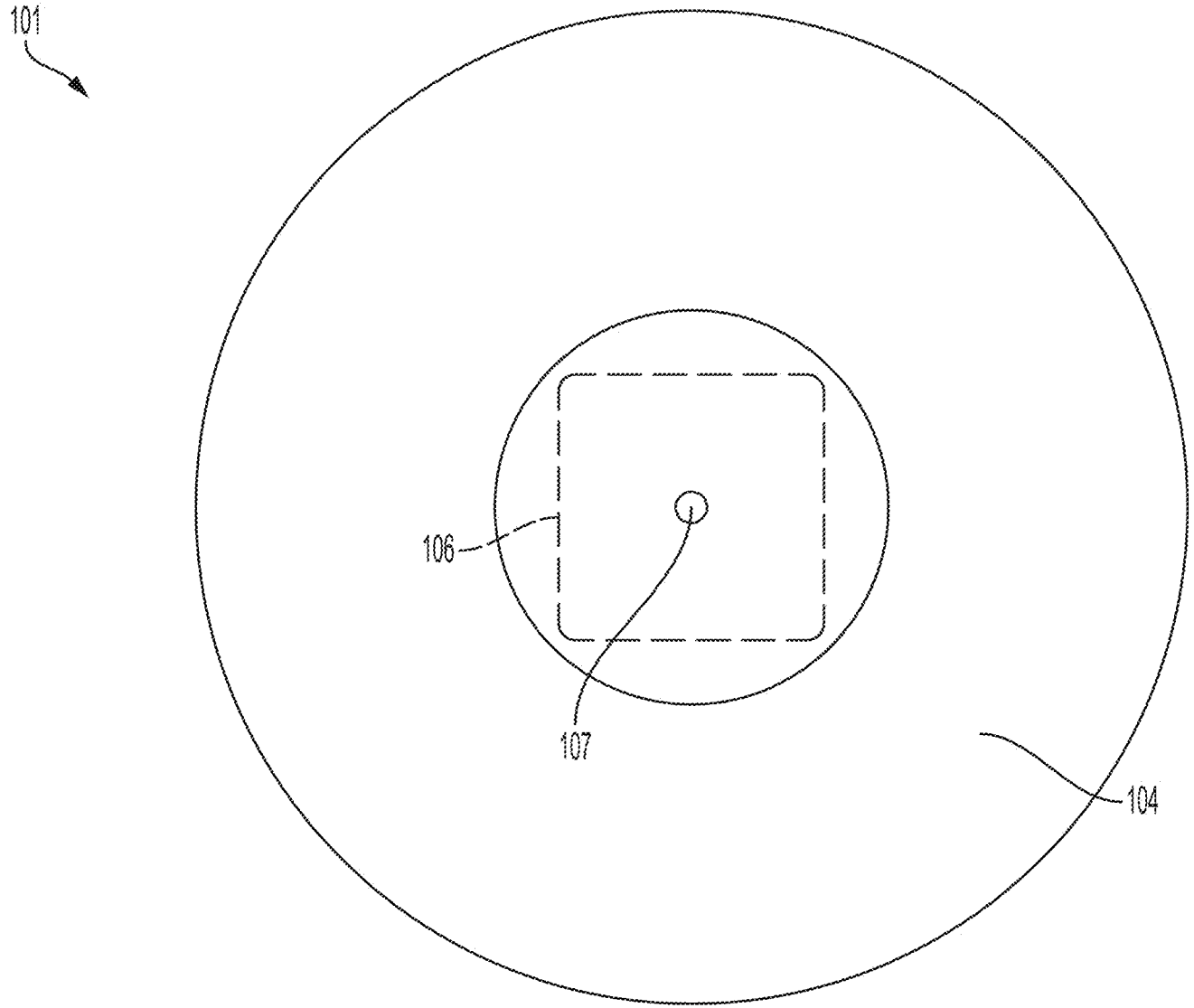
FIG. 3 is a bottom-view of an anchoring device having an adjustable injection valve according to one example of the present disclosure.

FIG. 3 is a bottom-view of the anchoring device 101 according to one example of the present disclosure. As illustrated, the bottom-view includes the run-in-hole guide 104, the adjustor nut 106, and the breather hole 107. In some examples, and instead of the adjustor nut 106, the anchoring device 101 can include other suitable adjustable features. The breather hole 107 can be positioned within the adjustor nut 106 (or other suitable adjustable feature), and the adjustor nut 106 can be positioned within the run-in-hole guide 104. The breather hole 107 can prevent atmospheric traps in the anchoring device 101 and can perform other suitable tasks with respect to the anchoring device 101.

Figure 4:
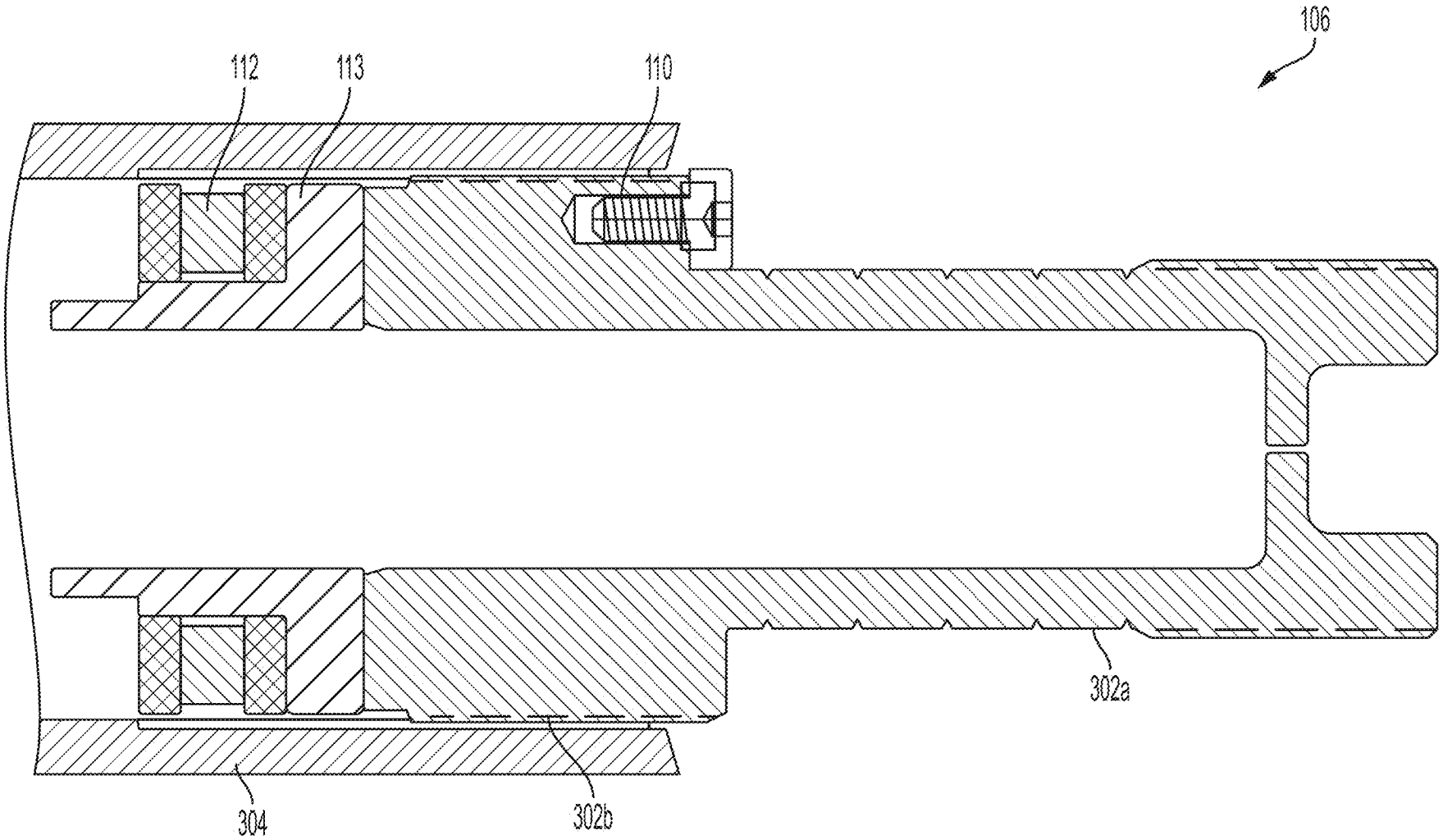
FIG. 4 is a sectional side-view of an adjustable feature of an anchoring device having an adjustable injection valve according to one example of the present disclosure.

FIG. 4 is a sectional side-view of the adjustor nut 106 according to one example of the present disclosure. The adjustor nut 106, or other suitable adjustable feature of the anchoring device 101, can include the locking bolt 110. Additionally, the adjustor nut 106 can be positioned adjacent to the platform 113 which can be positioned adjacent to the rotary bearings 112. The adjustor nut 106 can be characterized by a first set of threads 302*a* and a second set of threads 302*b*. The first set of threads 302*a* can be positioned on a first outer diameter of the adjustable injection valve 109 and adjacent to a corresponding set of threads positioned on the run-in-hole guide 104. The first set of threads 302*a* and the corresponding set of threads can have a similar or identical thread pitch. In some examples, the first set of threads 302*a* and the corresponding set of threads can have different thread pitches to prevent loosening in the wellbore. The run-in-hole guide 104 can be rotated around the first set of threads 302*a* for being positioned on the anchoring device 101.

The second set of threads 302*b* can be positioned on a second outer diameter of the adjustor nut 106. In some examples, the second outer diameter can be greater than the first outer diameter. The second set of threads 302*b* can additionally be positioned adjacent to a corresponding set of threads having similar or identical thread pitch compared to the second set of threads 302*b* and that is positioned on a housing 304 of the adjustable injection valve 109. In some examples, the second set of threads 302*b* and the corresponding set of threads can have different thread pitches to prevent loosening in the wellbore. The housing 304 can retain the spring 108, the breather hole 107, the barrier material, and other suitable components of an assembly that includes the adjustable injection valve 109. The locking bolt 110 can lock the additional pressure. In some examples, the pitch of the first set of threads 302*a* can be different than the second set of threads 302*b*.

Figure 5:
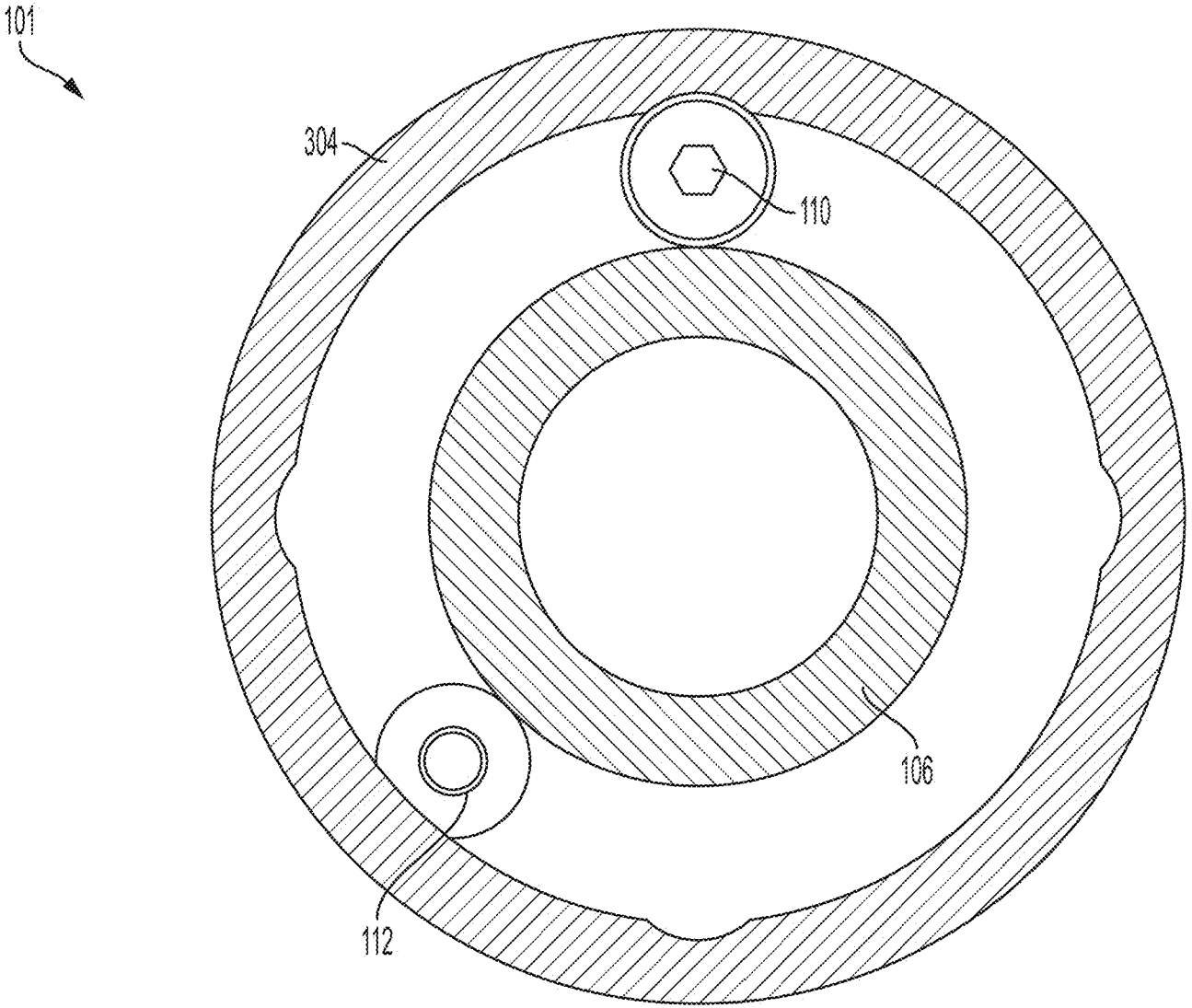
FIG. 5 is a bottom-view of an anchoring device having an adjustable injection valve and without a run-in-hole guide according to one example of the present disclosure.

FIG. 5 is a bottom-view of the anchoring device 101 without the run-in-hole guide 104 according to one example of the present disclosure. The bottom-view illustrates the adjustor nut 106, the housing 304, the locking bolt 110, and a rotary bearing 112. The adjustor nut 106 (or other suitable adjustable feature) can be positioned concentric with respect to the housing 304 of the anchoring device 101 or in other suitable configurations. The locking bolt 110 can be positioned on the adjustable injection valve 109 such that a head of the locking bolt 110 abuts threads positioned on the housing 304. The locking bolt 110 can be positioned in other suitable locations or configurations with respect to the adjustable injection valve 109, the housing 304, and the like.

Figure 6:
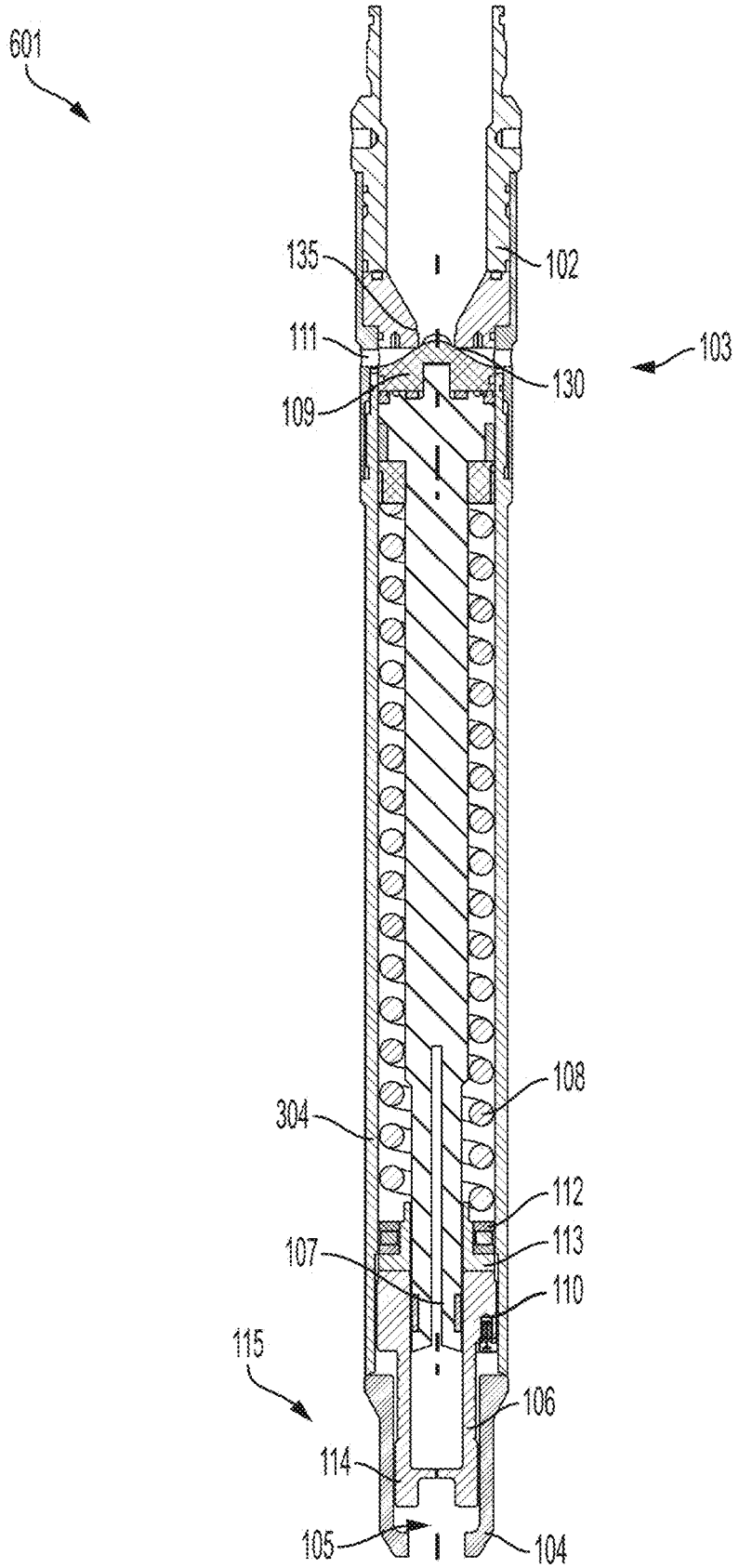
FIG. 6 is a sectional side-view of an anchoring device, having an adjustable injection valve, with a first preload applied to a spring according to one example of the present disclosure.
Figure 7:
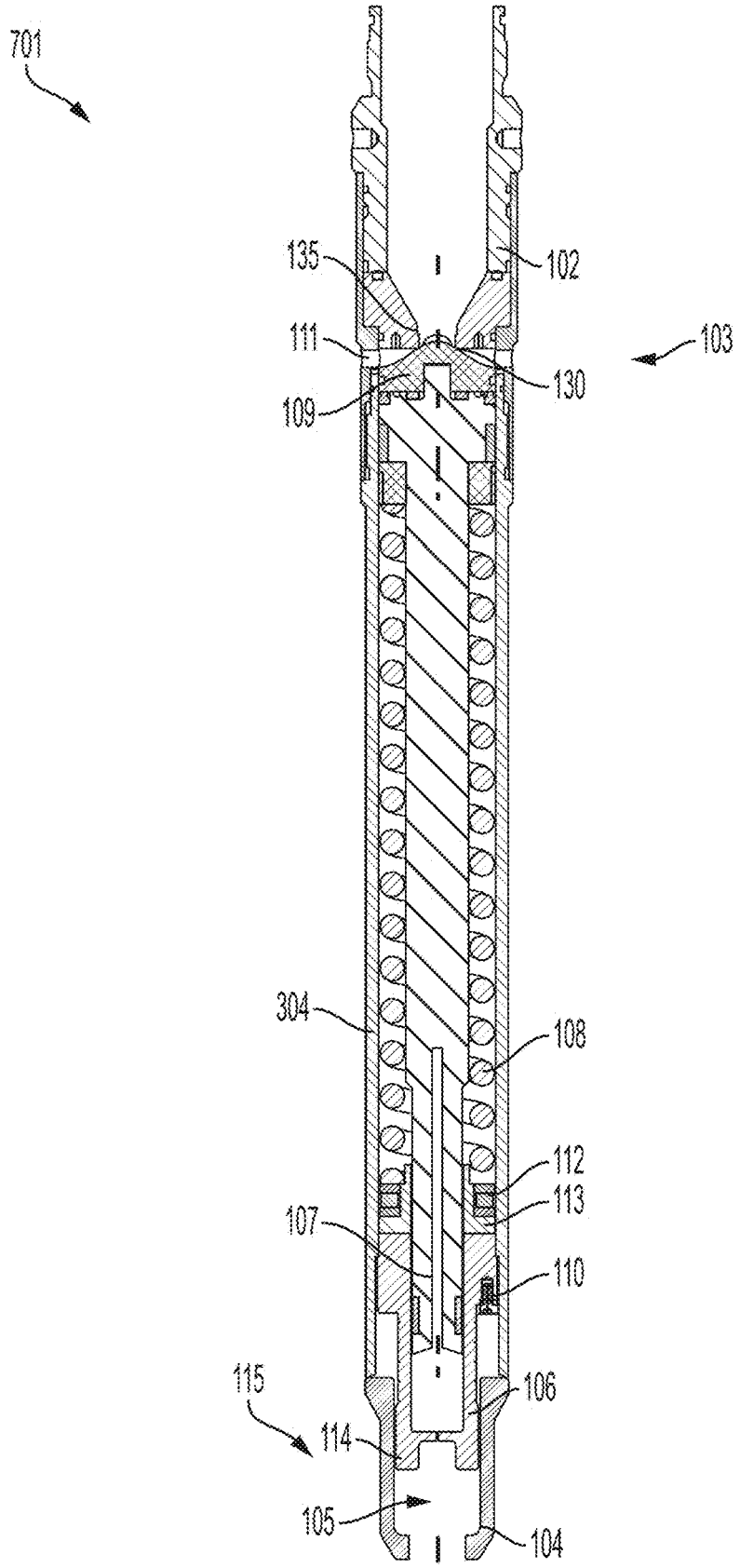
FIG. 7 is a sectional side-view of an anchoring device, having an adjustable injection valve, with a second preload applied to a spring according to one example of the present disclosure.
Figure 8:
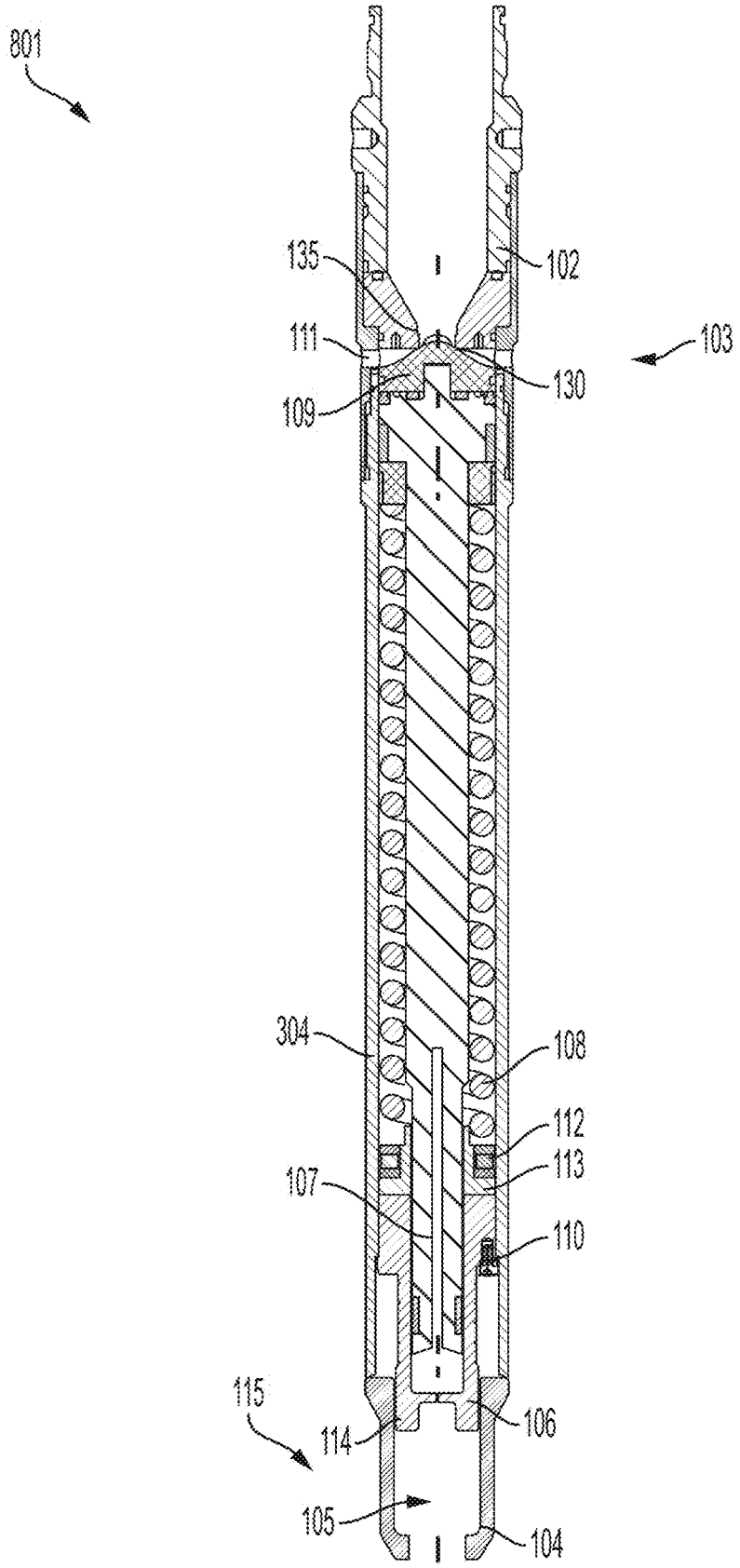
FIG. 8 is a sectional side-view of an anchoring device, having an adjustable injection valve, with a third preload applied to a spring according to one example of the present disclosure.

In some examples, FIGS. 6-8 may correspond to the same or similar anchoring devices having varying increments of preload applied to the spring 108. For example, a first preload may be applied to the anchoring device 601 illustrated in FIG. 6, a second preload may be applied to the anchoring device 701 illustrated in FIG. 7, and a third preload may be applied to the anchoring device 801 illustrated in FIG. 8 in which the first preload, the second preload, and the third preload may each be different from one another. Any other suitable preloads, or increments thereof, can be applied with respect to the anchoring devices illustrated, for example, in FIGS. 6-8.

FIG. 6 is a sectional side-view of an anchoring device 601, having an adjustable injection valve 109, with a first preload applied to a spring 108 according to one example of the present disclosure. The first preload illustrated in FIG. 6 may be greater than the preload illustrated with respect to FIG. 1. Accordingly, the spring 108 illustrated in FIG. 6 is compressed more than, and may store more spring-related energy than, the spring 108 illustrated with respect to FIG. 1. And, the bottom portion 114 of the adjustor nut 106 with respect to FIG. 6 may be located further from the run-in-hole guide 104 than the bottom portion 114 of the adjustor nut 106 with respect to FIG. 1. A cracking pressure or opening pressure generated by the spring 108 of the anchoring device 601 illustrated with respect to FIG. 6 may be greater than a cracking pressure or opening pressure generated by the spring 108 of the anchoring device 101 illustrated with respect to FIG. 1.

In some examples, the anchoring device 101 and the anchoring device 601 may be used for two separate wellbores. For example, the anchoring device 101 may be configured with a low preload, such as 50 bar (5,000,000 Pascals), on the spring 108 for use in a first wellbore that was formed with a high formation pressure. Additionally, the anchoring device 601 may be configured with the first preload, such as 100 bar (10,000,000 Pascals), on the spring 108 for use in a second wellbore that was formed with a lower formation pressure compared to the formation pressure of the first wellbore. The anchoring device 101 may not perform optimally in the second wellbore, and the anchoring device 601 may not perform optimally in the first wellbore. In some examples, the anchoring device 101 and the anchoring device 601 are the same anchoring device in two separate configurations corresponding to the first wellbore and to the second wellbore.

FIG. 7 is a sectional side-view of an anchoring device 701, having an adjustable injection valve 109, with a second preload applied to a spring 108 according to one example of the present disclosure. The second preload illustrated in FIG. 7 may be greater than the preload illustrated with respect to FIG. 6. Accordingly, the spring 108 illustrated in FIG. 7 is compressed more than, and may store more spring-related energy than, the spring 108 illustrated with respect to FIG. 6. And, the bottom portion 114 of the adjustor nut 106 with respect to FIG. 7 may be located further from the run-in-hole guide 104 than the bottom portion 114 of the adjustor nut 106 with respect to FIG. 6. A cracking pressure or opening pressure generated by the spring 108 of the anchoring device 701 illustrated with respect to FIG. 7 may be greater than a cracking pressure or opening pressure generated by the spring 108 of the anchoring device 601 illustrated with respect to FIG. 6.

In some examples, the anchoring device 601 and the anchoring device 701 may be used for two separate wellbores. For example, the anchoring device 601 may be configured with the first preload, such as 100 bar (10,000,000 Pascals), on the spring 108 for use in the second wellbore. Additionally, the anchoring device 701 may be configured with the second preload, such as 200 bar (20,000,000 Pascals), on the spring 108 for use in a third wellbore that was formed with a lower formation pressure than the formation pressure of the second wellbore. The anchoring device 601 may not perform optimally in the third wellbore, and the anchoring device 701 may not perform optimally in the second wellbore. In some examples, the anchoring device 601 and the anchoring device 701 are the same anchoring device in two separate configurations corresponding to the second wellbore and to the third wellbore.

FIG. 8 is a sectional side-view of an anchoring device 801, having an adjustable injection valve 109, with a third preload applied to a spring 108 according to one example of the present disclosure. The third preload illustrated in FIG. 8 may be greater than the preload illustrated with respect to FIG. 7. Accordingly, the spring 108 illustrated in FIG. 8 is compressed more than, and may store more spring-related energy than, the spring 108 illustrated with respect to FIG. 7. And, the bottom portion 114 of the adjustor nut 106 with respect to FIG. 8 may be located further from the run-in-hole guide 104 than the bottom portion 114 of the adjustor nut 106 with respect to FIG. 7. A cracking pressure or opening pressure generated by the spring 108 of the anchoring device 801 illustrated with respect to FIG. 8 may be greater than a cracking pressure or opening pressure generated by the spring 108 of the anchoring device 701 illustrated with respect to FIG. 7.

In some examples, the anchoring device 701 and the anchoring device 801 may be used for two separate wellbores. For example, the anchoring device 701 may be configured with the second preload, such as 200 bar (20,000,000 Pascals), on the spring 108 for use in the third wellbore. Additionally, the anchoring device 801 may be configured with the third preload, such as 300 bar (30,000,000 Pascals), on the spring 108 for use in a fourth wellbore that was formed with a lower formation pressure than the formation pressure of the third wellbore. The anchoring device 701 may not perform optimally in the fourth wellbore, and the anchoring device 801 may not perform optimally in the third wellbore. In some examples, the anchoring device 701 and the anchoring device 801 are the same anchoring device in two separate configurations corresponding to the third wellbore and to the fourth wellbore.

Figure 9:
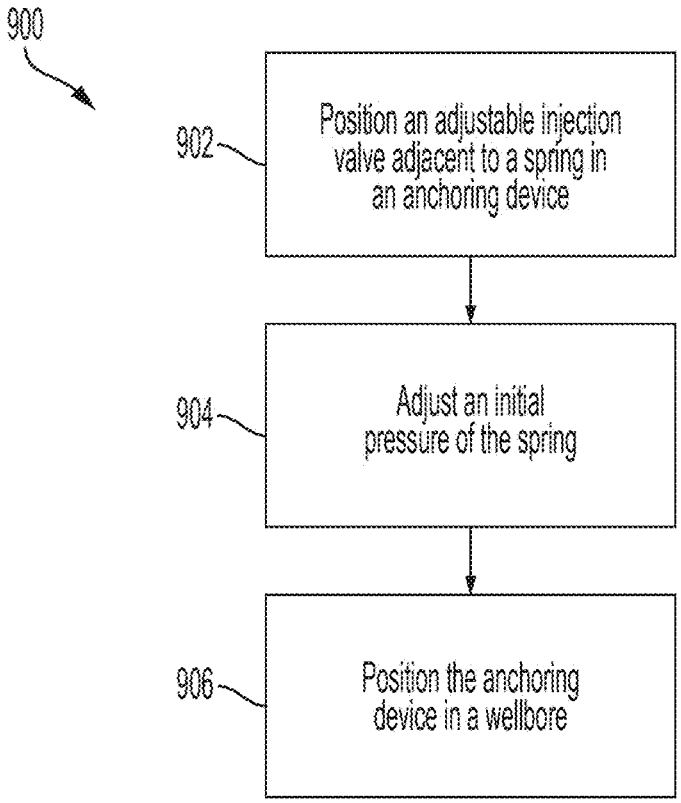
FIG. 9 is a flowchart of a process to adjust an adjustable injection valve for performing a wellbore operation according to one example of the present disclosure.

FIG. 9 is a flowchart of a process 900 to adjust an adjustable injection valve 109 for performing a wellbore operation according to one example of the present disclosure. At block 902, an adjustable injection valve 109 is positioned adjacent to a spring 108 in an anchoring device 101. The adjustable injection valve 109 can include a seat 130, a sealing surface 135, a radial hole 111, other suitable components, or a combination thereof. The seat 130 of the adjustable injection valve 109 can be positioned abutting the spring 108 for allowing the adjustable injection valve 109 to receive pressure or other suitable forces from the spring 108. In some example, the components (e.g., the seat 130, the sealing surface 135, the radial hole 111, etc.) of the adjustable injection valve 109 may be sized to mitigate or prevent damage to the anchoring device 101, the well system 100, or any suitable component thereof. For example, computational flow dynamics (or other suitable analysis or combination of analyses) can be used to determine a size of the radial hole 111 that may cause or facilitate a backpressure in the adjustable injection valve 109 during actuation for causing the adjustable injection valve 109 to remain open during actuation.

At block 904, an initial pressure of the spring 108 is adjusted. The initial pressure of the spring 108 may indicate a cracking pressure, or a threshold pressure above which the adjustable injection valve 109 may actuate or otherwise open. The cracking pressure may correspond to a formation pressure of a wellbore 116. For example, for a first wellbore having a high formation pressure, the cracking pressure may be lower than for a second wellbore having a lower formation pressure than that of the first wellbore.

In some examples, the initial pressure of the spring 108 can be adjusted using an adjustable feature (e.g., the adjustor nut 106) of the anchoring device 101. The adjustable feature can be adjusted (e.g., rotated, swapped, etc.) to adjust (e.g., increase or decrease) the initial pressure of the spring 108. For example, the adjustor nut 106 can be rotated or otherwise adjusted in a first direction for increasing the initial pressure on the spring 108 and may be rotated or otherwise adjusted in a second direction for decreasing the initial pressure on the spring 108. In some examples, the initial pressure on the spring 108 may be tuned (e.g., using computational flow dynamics, etc.) for allowing the filling or barrier material to flow via the adjustable injection valve 109 without slamming the adjustable injection valve 109 or otherwise causing damage to the anchoring device 101, the well system 100, or any components thereof.

At block 906, the anchoring device 101 is positioned downhole in a wellbore 116. The anchoring device 101 can be used to perform one or more wellbore operations. For example, the anchoring device 101 can be used to perform a wellbore plug and abandonment operation in which filling or barrier material is positioned in an abandoned wellbore. The anchoring device 101 can be positioned (e.g., via line 140, etc.) downhole in the wellbore 116 and can receive pressure from the surface 125. The pressure can include the cracking pressure, which may actuate the adjustable injection valve 109. Upon actuating the adjustable injection valve 109, a filling or barrier material (e.g., a cementitious material, gravel, sand, or other suitable filling or barrier material) can be positioned in the wellbore 116 via the anchoring device 101. For example, the anchoring device 101 can, upon actuating the adjustable injection valve 109, form a vacuum, in the wellbore 116, that can control flow of the filling or barrier material in the wellbore 116. Once the filling or barrier material is positioned or cured adequately in the wellbore 116, the adjustable injection valve 109 can return to a resting (e.g., unactuated or unopened) state in which the anchoring device 101 can be removed from the wellbore 116 and, for example, reused for one or more other wellbore operations (e.g., with respect to the wellbore 116 or any other suitable wellbore or well system).

In some aspects, anchoring devices, systems, and methods for an adjustable injection valve for a wellbore plug and abandonment anchoring device are provided according to one or more of the following examples.

As used below, any reference to a series of examples is to be understood as a reference to each of those examples disjunctively (e.g., "Examples 1-4" is to be understood as "Examples 1, 2, 3, or 4").

Example 1 is an anchoring device comprising: an adjustable injection valve; and a spring positioned adjacent to the adjustable injection valve, the spring having an initial pressure setting that is adjustable prior to the anchoring device being positioned in a wellbore to adjust a cracking pressure of the adjustable injection valve.

Example 2 is the anchoring device of example 1, further comprising an adjustor nut positioned around the adjustable injection valve, the adjustor nut rotatable to adjust the initial pressure of the spring.

Example 3 is the anchoring device of example 1, wherein the adjustable injection valve comprises: a sealing surface; a sealing seat positionable abutting the spring and the sealing surface before actuating the adjustable injection valve, the sealing seat movable away from the sealing surface for allowing fluid to flow from a surface of the wellbore to the anchoring device in response to the anchoring device receiving the cracking pressure; and a radial hole positionable on an exterior of the anchoring device for allowing the fluid to flow from the anchoring device to the wellbore.

Example 4 is the anchoring device of any of examples 1 and 3, wherein the radial hole is sized to receive filling material for a plug and abandonment operation in response to the adjustable injection valve actuating, and wherein the radial hole is sized to cause a backpressure in the adjustable injection valve for keeping the adjustable injection valve open during actuation of the adjustable injection valve.

Example 5 is the anchoring device of example 1, further comprising a locking screw positionable within the adjustable injection valve and adjacent to a housing of the adjustable injection valve for locking the initial pressure of the spring in place before the anchoring device is positioned in the wellbore.

Example 6 is the anchoring device of example 1, wherein the adjustable injection valve is openable for forming a vacuum in the wellbore to control flow of barrier fluid in the wellbore for performing a plug and abandonment operation.

Example 7 is the anchoring device of example 1, wherein the initial pressure setting corresponds to a formation pressure of the wellbore.

Example 8 is a method comprising: positioning an adjustable injection valve adjacent to a spring in an anchoring device; adjusting an initial pressure of the spring, the initial pressure corresponding to a cracking pressure of the adjustable injection valve; and positioning the anchoring device in a wellbore for performing a wellbore operation.

Example 9 is the method of example 8, wherein adjusting the initial pressure of the spring includes adjusting an adjustor nut positioned around the adjustable injection valve for adjusting the cracking pressure of the adjustable injection valve.

Example 10 is the method of example 8, wherein the adjustable injection valve includes a sealing surface, a sealing seat positioned abutting the spring and the sealing surface before actuating the adjustable injection valve, and a radial hole positioned on an exterior of the anchoring device, and wherein positioning the anchoring device in the wellbore for performing the wellbore operation includes applying the cracking pressure to the adjustable injection valve for moving the sealing seat away from the sealing surface and for allowing fluid to flow from the anchoring device to the wellbore via the radial hole.

Example 11 is the method of any of examples 8 and 10, wherein positioning the anchoring device in the wellbore includes receiving, at the adjustable injection valve, backpressure via the radial hole for keeping the adjustable injection valve open during actuation of the adjustable injection valve.

Example 12 is the method of example 8, wherein adjusting the initial pressure of the spring includes locking, using a locking screw positioned within the adjustable injection valve and adjacent to a housing of the adjustable injection valve, the initial pressure prior to positioning the anchoring device in the wellbore.

Example 13 is the method of example 8, wherein positioning the anchoring device in the wellbore includes opening the adjustable injection valve for forming a vacuum in the wellbore to control flow of barrier fluid in the wellbore for performing a plug and abandonment operation.

Example 14 is the method of example 8, wherein the initial pressure setting corresponds to a formation pressure of the wellbore.

Example 15 is a system comprising: an adjustable injection valve positionable on an anchoring device; a spring positionable on the anchoring device adjacent to the adjustable injection valve; and an adjustment feature positionable on the anchoring device to adjust, prior to positioning the anchoring device in a wellbore, an initial pressure setting of the spring to adjust a cracking pressure of the adjustable injection valve.

Example 16 is the system of example 15, wherein the adjustable injection valve comprises: a sealing surface; a sealing seat positionable abutting the spring and the sealing surface before actuating the adjustable injection valve, the sealing seat movable away from the sealing surface for allowing fluid to flow from a surface of the wellbore to the anchoring device in response to the anchoring device receiving the cracking pressure; and a radial hole positionable on an exterior of the anchoring device for allowing the fluid to flow from the anchoring device to the wellbore.

Example 17 is the system of any of examples 15-16, wherein the radial hole is sized to receive filling material for a plug and abandonment operation in response to the adjustable injection valve actuating, and wherein the radial hole is sized to cause a backpressure in the adjustable injection valve for keeping the adjustable injection valve open during actuation of the adjustable injection valve.

Example 18 is the system of example 15, further comprising a locking screw positionable within the adjustable injection valve and adjacent to a housing of the adjustable injection valve for locking the initial pressure of the spring in place before the anchoring device is positioned in the wellbore.

Example 19 is the system of example 15, wherein the adjustable injection valve is openable for forming a vacuum in the wellbore to control flow of barrier fluid in the wellbore for performing a plug and abandonment operation.

Example 20 is the system of example 15, wherein the initial pressure setting corresponds to a formation pressure of the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An anchoring device comprising:

an adjustable injection valve; and a spring positioned adjacent to the adjustable injection valve, the spring having an initial pressure setting that is adjustable prior to the anchoring device being positioned in a wellbore to adjust a cracking pressure of the adjustable injection valve, wherein the adjustable injection valve is adjustable for forming a vacuum in the wellbore to control flow of barrier fluid in the wellbore.

2. The anchoring device of claim 1, further comprising an adjuster nut positioned around the adjustable injection valve, the adjuster nut rotatable to adjust the initial pressure of the spring.

3. The anchoring device of claim 1, wherein the adjustable injection valve comprises:

a sealing surface;

a sealing seat positionable abutting the spring and the sealing surface before actuating the adjustable injection valve, the sealing seat movable away from the sealing surface for allowing fluid to flow from a surface of the wellbore to the anchoring device in response to the anchoring device receiving the cracking pressure; and a radial hole positionable on an exterior of the anchoring device for allowing the fluid to flow from the anchoring device to the wellbore.

4. The anchoring device of claim 3, wherein the radial hole is sized to receive filling material for a plug and abandonment operation in response to the adjustable injection valve actuating, and wherein the radial hole is sized to cause a backpressure in the adjustable injection valve for keeping the adjustable injection valve open during actuation of the adjustable injection valve.

5. The anchoring device of claim 1, further comprising a locking screw positionable within the adjustable injection valve and adjacent to a housing of the adjustable injection valve for locking the initial pressure of the spring in place before the anchoring device is positioned in the wellbore.

6. The anchoring device of claim 1, wherein the initial pressure setting corresponds to a formation pressure of the wellbore.

7. A method comprising:

positioning an adjustable injection valve adjacent to a spring in an anchoring device;

adjusting an initial pressure of the spring, the initial pressure corresponding to a cracking pressure of the adjustable injection valve; and positioning the anchoring device in a wellbore for performing a wellbore operation, wherein positioning the anchoring device in the wellbore includes adjusting the adjustable injection valve for forming a vacuum in the wellbore to control flow of barrier fluid in the wellbore.

8. The method of claim 7, wherein adjusting the initial pressure of the spring includes adjusting an adjuster nut positioned around the adjustable injection valve for adjusting the cracking pressure of the adjustable injection valve.

9. The method of claim 7, wherein the adjustable injection valve includes a sealing surface, a sealing seat positioned abutting the spring and the sealing surface before actuating the adjustable injection valve, and a radial hole positioned on an exterior of the anchoring device, and wherein positioning the anchoring device in the wellbore for performing the wellbore operation includes applying the cracking pressure to the adjustable injection valve for moving the sealing seat away from the sealing surface and for allowing fluid to flow from the anchoring device to the wellbore via the radial hole.

10. The method of claim 9, wherein positioning the anchoring device in the wellbore includes receiving, at the adjustable injection valve, backpressure via the radial hole for keeping the adjustable injection valve open during actuation of the adjustable injection valve.

11. The method of claim 7, wherein adjusting the initial pressure of the spring includes locking, using a locking screw positioned within the adjustable injection valve and adjacent to a housing of the adjustable injection valve, the initial pressure prior to positioning the anchoring device in the wellbore.

12. The method of claim 7, wherein the initial pressure setting corresponds to a formation pressure of the wellbore.

13. A system comprising:

an adjustable injection valve positionable on an anchoring device;

a spring positionable on the anchoring device adjacent to the adjustable injection valve; and an adjustment feature positionable on the anchoring device to adjust, prior to positioning the anchoring device in a wellbore, an initial pressure setting of the spring to adjust a cracking pressure of the adjustable injection valve, wherein the adjustable injection valve is adjustable for forming a vacuum in the wellbore to control flow of barrier fluid in the wellbore.

14. The system of claim 13, wherein the adjustable injection valve comprises:

a sealing surface;

a sealing seat positionable abutting the spring and the sealing surface before actuating the adjustable injection valve, the sealing seat movable away from the sealing surface for allowing fluid to flow from a surface of the wellbore to the anchoring device in response to the anchoring device receiving the cracking pressure; and a radial hole positionable on an exterior of the anchoring device for allowing the fluid to flow from the anchoring device to the wellbore.

15. The system of claim 14, wherein the radial hole is sized to receive filling material for a plug and abandonment operation in response to the adjustable injection valve actuating, and wherein the radial hole is sized to cause a backpressure in the adjustable injection valve for keeping the adjustable injection valve open during actuation of the adjustable injection valve.

16. The system of claim 13, further comprising a locking screw positionable within the adjustable injection valve and adjacent to a housing of the adjustable injection valve for locking the initial pressure of the spring in place before the anchoring device is positioned in the wellbore.

17. The system of claim 13, wherein the initial pressure setting corresponds to a formation pressure of the wellbore.

* * * * *